US007450896B2

(12) United States Patent
Nojima

(10) Patent No.: US 7,450,896 B2
(45) Date of Patent: Nov. 11, 2008

(54) SHEET TRANSPORT APPARATUS AND IMAGE FORMING APPARATUS

(75) Inventor: Koji Nojima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 407 days.

(21) Appl. No.: 11/225,275

(22) Filed: Sep. 13, 2005

(65) Prior Publication Data

US 2006/0056861 A1 Mar. 16, 2006

(30) Foreign Application Priority Data

Sep. 15, 2004 (JP) ..... 2004-269017

(51) Int. Cl.
*G03G 15/00* (2006.01)
*B65H 5/22* (2006.01)

(52) U.S. Cl. ..... 399/388; 271/3.17; 271/3.16

(58) Field of Classification Search ..... 271/3.14–3.18, 271/4.01, 4.02, 4.03, 4.08, 10.01, 10.02, 271/10.03, 10.04, 10.05; 400/624, 625, 636, 400/636.3, 637, 637.1; 399/388–405
See application file for complete search history.

(56) References Cited

U.S. PATENT DOCUMENTS 6,499,734 B1 * 12/2002 Tranquilla ..... 271/10.03
6,827,279 B2 12/2004 Teraura

FOREIGN PATENT DOCUMENTS

| | | | | |
|---|---|---|---|---|
| JP | 401172148 A | * | 7/1989 | ..... 271/125 |
| JP | 05-005750 A | | 1/1993 | |
| JP | 05-034370 A | | 2/1993 | |
| JP | 05-313516 A | | 11/1993 | |
| JP | 06-331648 A | | 12/1994 | |
| JP | 07-215538 A | | 8/1995 | |
| JP | 2002-337426 A | | 11/2002 | |

OTHER PUBLICATIONS

JP 05-313516 English translation of Abstract.*

* cited by examiner

*Primary Examiner*—Allister Primo
(74) *Attorney, Agent, or Firm*—Canon USA Inc I.P. Div

(57) ABSTRACT

A sheet transport apparatus includes a fixed driving roller and a driven roller capable of coming into contact with or being separated from the driving roller, the driving roller and driven roller being capable of rotating and transporting a sheet interposed therebetween; a rotating-body acceleration sensor moving together with the driven roller and capable of detecting acceleration of movement of the driven roller; and a determining unit for determining, based on the acceleration detected by the rotating-body acceleration sensor, the arrival of a sheet at the driving roller and the driven roller, and the thickness of a sheet.

18 Claims, 12 Drawing Sheets

SHEET TRANSPORT APPARATUS AND IMAGE FORMING APPARATUS

CROSS REFERENCE TO RELATED APPLICATIONS

This application is related to co-pending application Ser. No. 11/225,274 filed on Sep. 13, 2005.

BACKGROUND OF THE INVENTION

1. Field of the Invention

The present invention relates to a sheet transport apparatus for transporting sheets and an image forming apparatus having the sheet transport apparatus.

2. Description of the Related Art

Known image forming apparatuses for forming images on a sheet are provided with a sheet transport apparatus for transporting sheets. Examples of image forming apparatuses include copiers, printers, facsimiles, and multifunction machines combining the functions of copiers, printers, and facsimiles.

Some sheet transport apparatuses detect the thickness of a sheet. Such sheet transport apparatuses are provided with a sheet detector that detects, for example, a position where, in the image forming apparatus, a sheet is currently being transported and the thickness of the sheet.

For example, a sheet detector included in an electrophotographic-type copier detects the movement of a sheet fed from the sheet cassette, and allows the detected timing to be used as information for controlling the sheet transport apparatus and image forming section on the downstream side.

Known sheet detectors will be described below.

Examples of Known Sheet Detector Detecting Arrival of Sheet

<First Sheet Detector>

A first example of a sheet detector detecting the arrival of a sheet is a photointerrupter sensor 258 shown in FIG. 10. The photointerrupter sensor 258 includes a rotatable flag 251 arranged in a position that blocks the sheet path, and a photointerrupter 253 detecting that detection light 253*a* is intercepted. A spring 252*a* presses the flag 251 into contact with a stopper 252*b*.

When a sheet S is brought into contact with the flag 251 in the photointerrupter sensor 258, the flag 251 is rotated about the rotation shaft 251*a* and causes a light-shielding section 251*b* to block the detection light 253*a* . When the detection light 253*a* is blocked, the photointerrupter sensor 258 emits an electronic signal based on the determination that the sheet S has arrived. The electronic signal is transmitted to a controller (not shown) that controls the entire image forming apparatus.

<Second Sheet Detector>

A second example of a sheet detector is a light transmission sensor 260 shown in FIG. 11. The light transmission sensor 260 detects a sheet when the sheet blocks the optical axis. The light transmission sensor 260 includes a light emitter 260*a* emitting detection light 260*c* and a light receptor 260*b*. Unlike the photointerrupter sensor 258 in FIG. 10, the light transmission sensor 260 has no flag blocking the sheet path. This is advantageous in that the front edge of the sheet is not damaged even if the sheet is thin.

Examples of Known Sheet Detector Detecting Arrival and Thickness of Sheet

Electrophotographic-type image forming apparatuses often detect not only the movement of a sheet, but also detect the thickness of a sheet to control the operation of the image forming section. For example, in an electrophotographic-type image forming apparatus, which uses electric power to transfer toner to a sheet, it is desired that a voltage applied to the sheet be adjusted according to the thickness of the sheet.

The thickness information is also used to control the sheet transport mechanism. Before enabling the sheet transport mechanism to feed a sheet to the image forming section, the image forming apparatus brings the front edge of the sheet into contact with a resist roller at rest to correct the skew of the sheet, adjusts timing for starting the rotation of the resist roller, thereby adjusting timing for feeding the sheet to the image forming section. After bringing the sheet into contact with the resist roller, the image forming apparatus causes a transport roller, which allows a sheet to be fed into the resist roller, to rotate for a predetermined time (t) to create a loop in front of the resist roller. The force of the loop causes the front edge of the sheet to be reliably pressed against the resist roller, thereby allowing the skew of the sheet to be corrected. The time (t) is determined according to the thickness of the sheet. For example, for a thin sheet, the time (t) must be long enough to ensure the pressing force with which the sheet is pressed against the resist roller.

Since it is often required for image forming apparatuses to detect the thickness of the sheet, the following sheet detectors are proposed.

<Third Sheet Detector>

Referring to FIG. 12, a sheet detector 281 combines a sheet transport mechanism 282 and a contact-type probe sensor 264. The sheet transport mechanism 282 is configured such that a sheet S is introduced into the nip point between a roller 262*a* attached to a roller shaft 263*a* that is vertically displaceable, and a roller 262*b* attached to a roller shaft 263*b* that is secured so as not to be vertically displaced. The sheet detector 281 uses the contact-type probe sensor 264 to measure the displacement of the roller shaft 263*a*, the displacement being associated with the passage of the sheet S. This not only allows the detection of the arrival of the sheet S, but also allows the detection of the thickness of the sheet S. This configuration is disclosed in Japanese Patent Laid-Open No. 07-215538.

<Fourth Sheet Detector>

Similar to the sheet detector 281 in FIG. 12, a sheet detector 283 in FIG. 13 measures the displacement of a roller 271 to detect the arrival and thickness of a sheet. The sheet detector 283 differs from the sheet detector 281 in that it has a sheet thickness sensor 270 using reflecting light 270*a* to measure the displacement. The sheet detector 283 controls a transfer charging device 274 according to the thickness and electric resistance value of the sheet. The transfer charging device 274 transfers toner images on a photoconductive drum (not shown) onto the sheet. This configuration is disclosed in Japanese Patent Laid-Open No. 05-313516.

There is another proposed method to detect the displacement of a roller. In this method, a pressure sensor supported by an elastic member is pressed against a roller shaft, and a change in pressure is interpreted as the displacement of the roller. However, this method has problems in that the pressure sensor cannot easily detect the arrival of a thin sheet unless the spring constant of the elastic member is high enough, and that the nip pressure of the roller becomes unstable if the spring constant is too high.

The above-described sheet detectors that are proposed or already in practical use have problems described in the following (1) to (5). For example, known sheet detectors with such problems cannot easily transport a thin sheet, cannot be installed in a desired location, have a low accuracy in detecting the position or thickness of a sheet, and malfunction in the detection of the position or thickness of a sheet. Moreover, known image forming apparatuses having a sheet detector with these problems have a low accuracy in forming images on a sheet.

(1) The photointerrupter sensor 258 in FIG. 10 may obstruct the transport of a thin sheet.

(2) Problems in installation space: In the photointerrupter sensor 258, the rotation shaft 251*a* of the flag 251 and the photointerrupter 253 must be placed close to the sheet paths. Business machines, which are typically required to be small in size, have many sections where a plurality of connected and crossed sheet paths are densely arranged. Such a section may not be able to provide enough space to accommodate the photointerrupter 253. Similarly, installation space for the light transmission sensor 260 in FIG. 11, the contact-type probe sensor 264 in FIG. 12, and the sheet thickness sensor 270 in FIG. 13 may not be large enough.

(3) Problems in Installation: Since it is required for the photointerrupter sensor 258 that the positional relationship between the rotation shaft 251*a* and the photointerrupter 253 be kept constant, their attaching parts must be stable. If the rotation shaft 251*a* and the photointerrupter 253 need to be attached to different members, instability of the attaching parts affects detection accuracy. The same applies to the light transmission sensor 260 in FIG. 11.

For the contact-type probe sensor 264 in FIG. 12 and the sheet thickness sensor 270 in FIG. 13, an unstable positional relationship with respect to the respective rollers may cause detection errors. That is, instability of a base to which the sensor is attached causes detection errors.

(4) Problems of Dirt on Sensor: The light transmission sensor 260 in FIG. 11 and the sheet thickness sensor 270 in FIG. 13 may malfunction if the emitter or receiver of the detection light is soiled with paper dust from the sheet, abrasion dust and oil from the drive mechanisms, and the like.

(5) Problems of External Vibrations: The contact-type probe sensor 264 in FIG. 12 and the sheet thickness sensor 270 in FIG. 13 may malfunction if the roller 262*a* or the roller 271 is displaced due to vibrations transmitted from outside the sheet transport apparatus or generated inside the sheet transport apparatus. Detection errors can be prevented, to some extent, if the frame of the sheet transport apparatus is provided with an acceleration sensor such that the amount of displacement of the roller can be compared to the acceleration detected by the acceleration sensor. However, since acceleration applied to the frame and the amount of displacement of the roller are different types of physical quantities, it is difficult to completely prevent detection errors even if some predictions can be made about the relationship between the acceleration and the amount of displacement. The same applies to the case where a pressure sensor is used to detect the displacement of the roller.

SUMMARY OF THE INVENTION

The present invention is directed to a sheet transport apparatus capable of reliably detecting the position and thickness of a sheet without using a sensor flag, but using an acceleration sensor included in the sheet transport apparatus.

The present invention is directed to a sheet transport apparatus capable of reliably determining the state of a sheet, such as the position and thickness of a sheet, and an image forming apparatus with improved accuracy in the formation of images.

In one aspect of the present invention, a sheet transport apparatus includes a pair of rotating bodies configured to come into contact with or to separate from each other, to rotate, and to transport a sheet interposed therebetween; an acceleration sensor configured to detect acceleration of movement of the pair of rotating bodies coming into contact with or separating from each other; and a determining unit determining, based on the acceleration detected by the acceleration sensor, a state of the sheet being transported.

Further features of the present invention will become apparent from the following description of exemplary embodiments with reference to the attached drawings.

BRIEF DESCRIPTION OF THE DRAWINGS

FIG. 2A shows the state when a sheet is being transported. FIG. 2B shows the state when a sheet has arrived and its thickness is being measured. FIG. 2C shows the state when a sheet is being bent.

FIG. 9A shows a detection waveform of a rotating-body acceleration sensor. FIG. 9B shows a detection waveform of a supporting-body acceleration sensor. FIG. 9C shows a waveform obtained by subtracting the waveform in FIG. 9B from the waveform in FIG. 9A.

DESCRIPTION OF THE EMBODIMENTS

A sheet transport apparatus according to embodiments of the present invention, and a copier serving as an image forming apparatus having the sheet transport apparatus will now be described with reference to the drawings.

The image forming apparatus of the present invention is not only applicable to copiers, but also to printers, facsimiles, and multifunction machines combining the functions of a copier, printer, and facsimile.

The sheet transport apparatus is not only included in the image forming apparatus, such as a copier, but also in other apparatuses dealing with sheets, such as a perforating apparatus for perforating sheets and a bending apparatus for bending sheets.

Copiers

Figure 1:
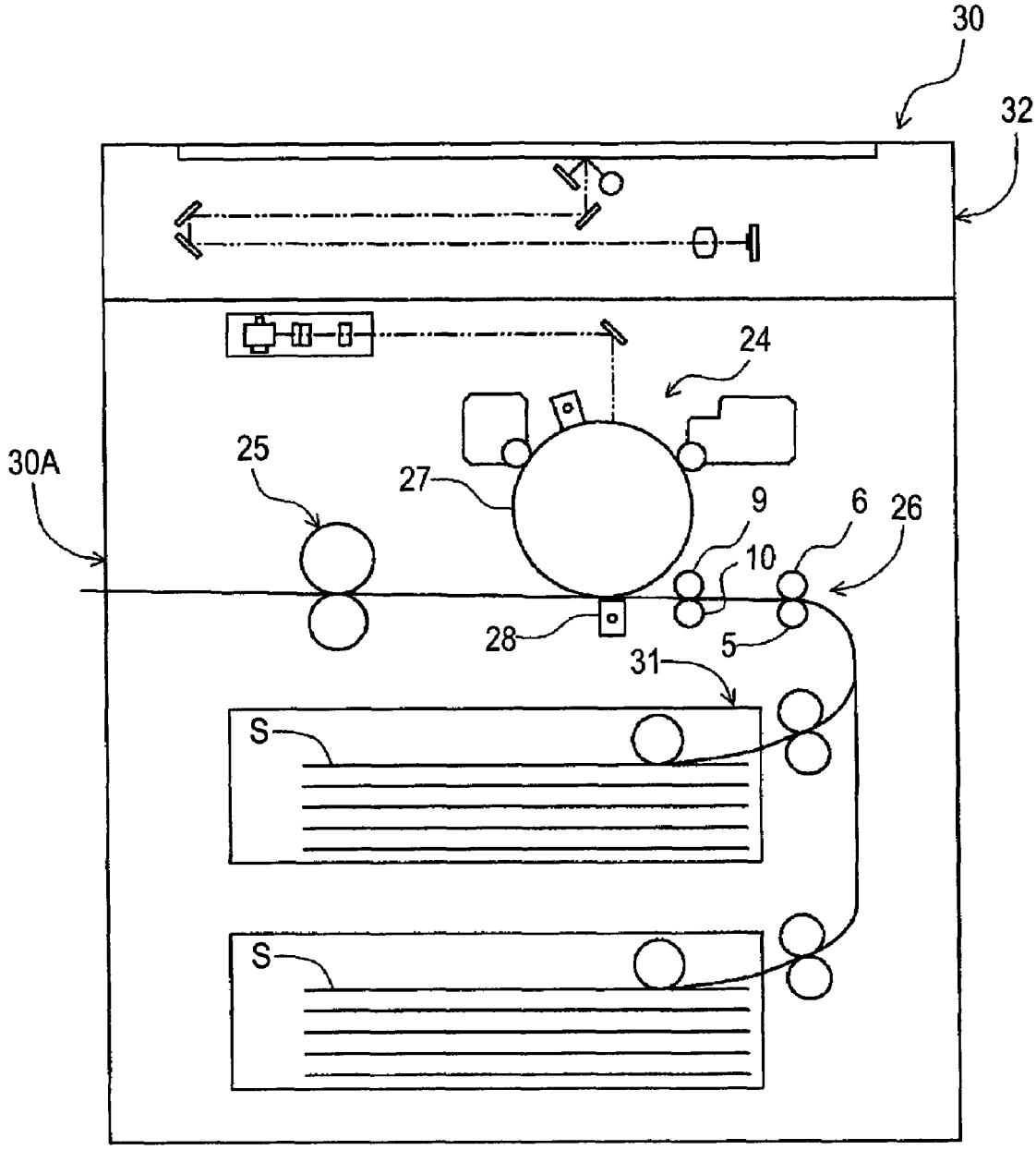
FIG. 1 is a front cross-sectional view of a copier serving as an image forming apparatus having a sheet transport apparatus according to embodiments of the present invention.

FIG. 1 is a front cross-sectional view of a copier serving as an image forming apparatus. A copier 30 includes a reader 32, a feeder 31, an image forming section 24, and a fixer 25. A sheet from the feeder 31 is introduced into the nip point between a driven roller 5, provided with a rotating-body acceleration sensor 1 (see FIG. 2), and serving as a movable rotating body and a driving roller 6 serving as a fixed rotating body. The sheet is then brought into contact with a pair of resist rollers 9 and 10. A skew of the sheet is thus corrected. Then, the sheet is sent, at a predetermined timing, to the image forming section 24 having a photoconductive drum 27. A document image read by the reader 32 is formed as a toner image on the photoconductive drum 27. The toner image is transferred by a transfer charging device 28 onto the sheet, which is further sent to the fixer 25, by which the toner image is fixed to the sheet. Finally, the sheet is ejected from the main body 30A of the copier.

Sheet Transport Apparatus of First Embodiment

A sheet transport apparatus according to the first embodiment of the present invention will now be described with reference to FIGS. 2 to 7.

A sheet transport apparatus 26 includes a driving roller 6 driven by a drive unit 40*a*, a driven roller 5 pressed by a pressure spring 2 into contact with the driving roller 6, a fixed bearing 8 supporting the driving roller 6, a movable bearing 3 rotatably supporting the driven roller 5, the rotating-body acceleration sensor 1 serving as a sheet detector integrally attached to the bearing 3, and a controller 40 for detecting the arrival and exit timing of the sheet S and determining the thickness of the sheet S, based on acceleration "a" detected by the rotating-body acceleration sensor 1.

The controller 40 controls the drive unit 40*a* causing the driving roller 6 to rotate, and the drive unit 40*b* causing the pair of resist rollers 9 and 10 to rotate. The drive unit 40*a* and the drive unit 40*b* have respective motors (not shown). The resist roller 10 is pressed by a spring 13 against the resist roller 9 in such a manner that variations in thickness of the sheet can be accommodated.

If the rotating-body acceleration sensor 1 affects the movement of the bearing 3, the controller 40 cannot accurately detect the arrival and exit timing and the thickness of the sheet. As such, the rotating-body acceleration sensor 1 is small and light weight to easily move with the bearing 3.

The rotating-body acceleration sensor 1 in the present embodiment is an extremely small and lightweight micro-electro-mechanical system (hereinafter abbreviated as "MEMS") sensor, as small as several square millimeters. A MEMS acceleration sensor is a sensor produced using MEMS technology.

MEMS Acceleration Sensor (1) MEMS Technology

MEMS technology is a technology for forming a minute mechanical structure and an electric circuit on a substrate through an exposure process used in semiconductor manufacturing. The MEMS technology allows the production of minute sensors and actuators of several millimeters in size, which was impossible with known technology, at extremely low cost. Acceleration sensors produced using MEMS technology have already been put to wide practical use. The structures of acceleration sensors produced using MEMS technology are disclosed in Japanese Patent Laid-Open Nos. 05-5750, 05-34370, and 06-331648. A MEMS acceleration sensor described in Japanese Patent Laid-Open No. 06-331648 will now be explained.

(2) Structure of MEMS Acceleration Sensor

Figure 4:
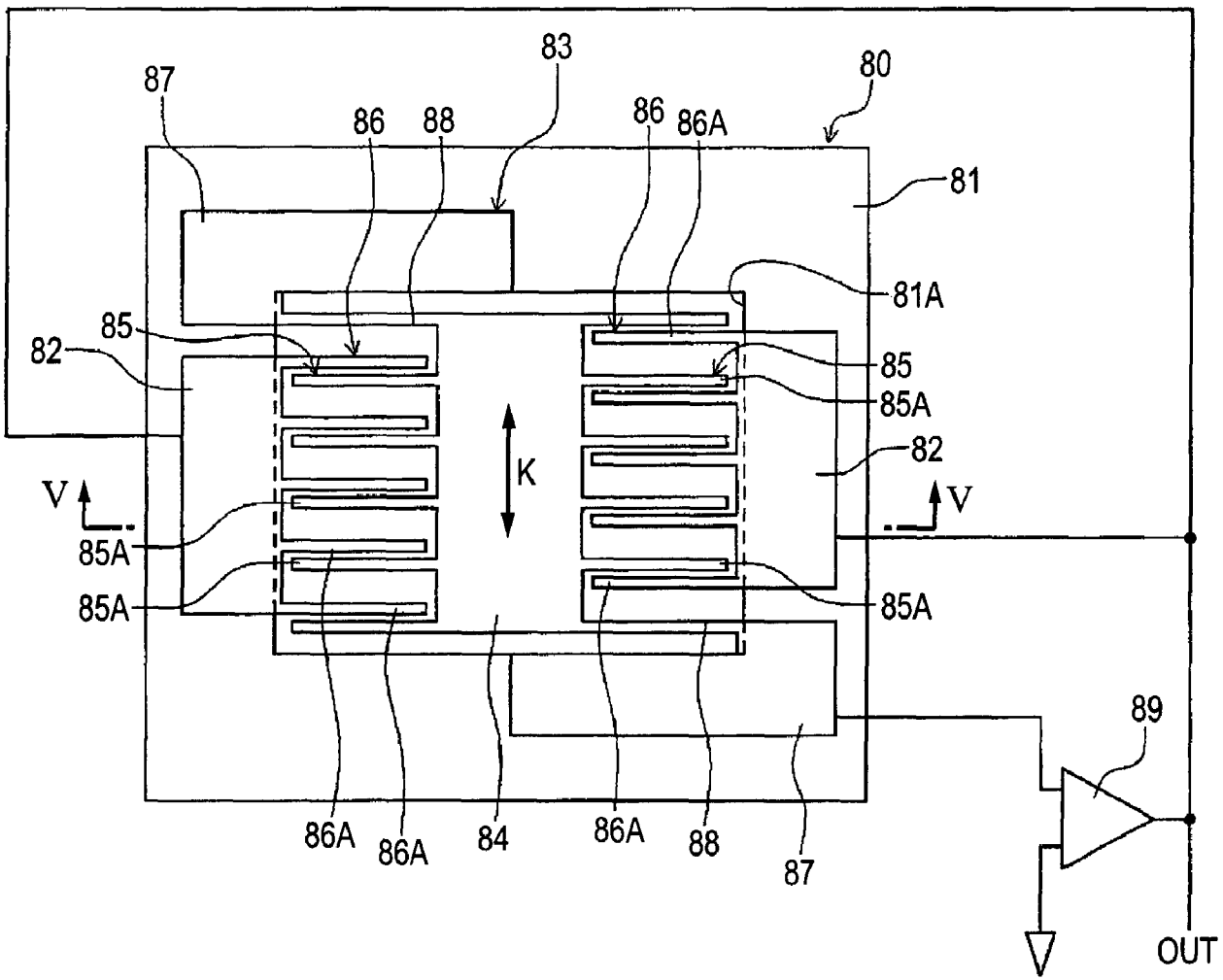
FIG. 4 is a plan view of a micro-electro-mechanical system (MEMS) acceleration sensor.

As shown in FIG. 4, a glass substrate 81 serving as an insulating substrate of a MEMS acceleration sensor 80 is provided with fixed parts 82 made of silicon and serving as electrodes, and a movable part 83 serving as a detection part. In addition, the glass substrate 81 has a rectangular concave portion 81A on which a mass portion 84 having a movable comb-shaped electrode 85 is arranged in a displaceable manner in a direction K (direction to which acceleration is applied).

The fixed part 82 is separately arranged on the respective left and right sides of the glass substrate 81 with a plurality of (for example, five) thin electrode plates 86A disposed therebetween. The plurality of electrode plates 86A constitute a fixed comb-shaped electrode 86 serving as a fixed electrode.

The movable part 83 includes two supporting parts 87 secured to the respective front and rear portions of the glass substrate 81, the mass portion 84 supported by thin beams 88, and a plurality of (for example, five) thin electrode plates 85A protruding in the respective left and right directions from the mass portion 84. The plurality of electrode plates 85A constitutes the movable comb-shaped electrode 85.

There are narrow spaces between the electrode plates 85A of the movable comb-shaped electrode 85 and the electrode plates 86A of the fixed comb-shaped electrode 86. The application of acceleration in the direction K to the entire MEMS acceleration sensor 80 causes the mass portion 84 to move in the direction K, thereby changing the size of the spaces. The fixed parts 82 and the movable part 83 are connected to an amplifier 89.

(3) Production Process of MEMS Acceleration Sensor

Figure 5:
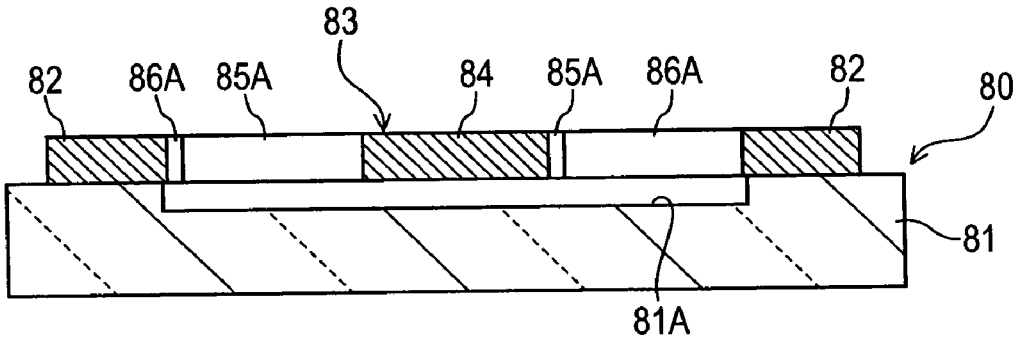
FIG. 5 is a cross-sectional view taken along line V-V in FIG. 4.
Figure 6:
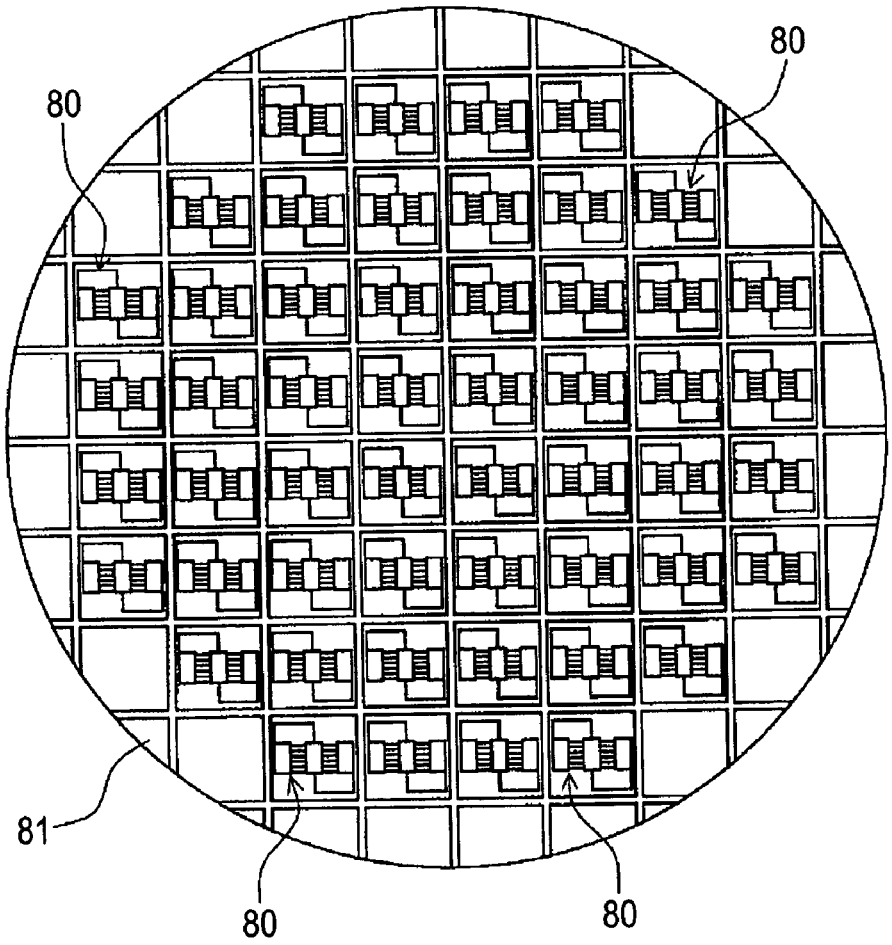
FIG. 6 is a plan view showing a silicon wafer on which many MEMS acceleration sensors are produced.

The production process of the MEMS acceleration sensor 80 will now be described with reference to FIGS. 4 to 6.

A silicon wafer with a diameter ranging from about 7.5 to 15.5 cm, and a thickness of about 300 μm is masked and etched to form a plurality of mass portions 84, electrode plates 85A, electrode plates 86A, and fixed parts 82.

A disk-shaped glass substrate having the same size as that of the silicon wafer is etched to form the plurality of concave portions 81A.

The glass substrate and the silicon wafer are joined by anodic bonding. As shown in FIG. 6, the plurality of MEMS acceleration sensors 80 is thus formed on the glass substrate 81.

The plurality of MEMS acceleration sensors 80 on the glass substrate 81 are cut into several-millimeter square chips.

With this production process, the MEMS acceleration sensors 80 are produced in quantities of several dozen at a time and are made compact and lightweight. The amplifier 89 in FIG. 4 may also be produced on the glass substrate 81 at the same time using known semiconductor manufacturing technology. Structural bodies formed using MEMS technology, such as the MEMS acceleration sensor 80, have a significant advantage in that peripheral circuits can be formed on the substrate simultaneously with the formation of the structural body.

(4) Operation of MEMS Acceleration Sensor

When acceleration is applied in the direction K as in FIG. 4, the MEMS acceleration sensor 80 changes the size of the narrow spaces between the electrode plates 85A and the electrode plates 86A, and causes the amplifier 89 to amplify and output this change as a change in capacitance. Based on the amount of this output, the MEMS acceleration sensor 80 transmits the amount of acceleration to the outside. Since the electrode plates 85A and the electrode plates 86A of the MEMS acceleration sensor 80 in this example are electrically connected in parallel, the amount of acceleration can be determined based on the total capacitance obtained by summing the capacitance between the electrode plates 85A and the electrode plates 86A. This improves sensitivity and accuracy of detection.

(5) Other Characteristics of MEMS Acceleration Sensor (Wireless Configuration)

Figure 7:
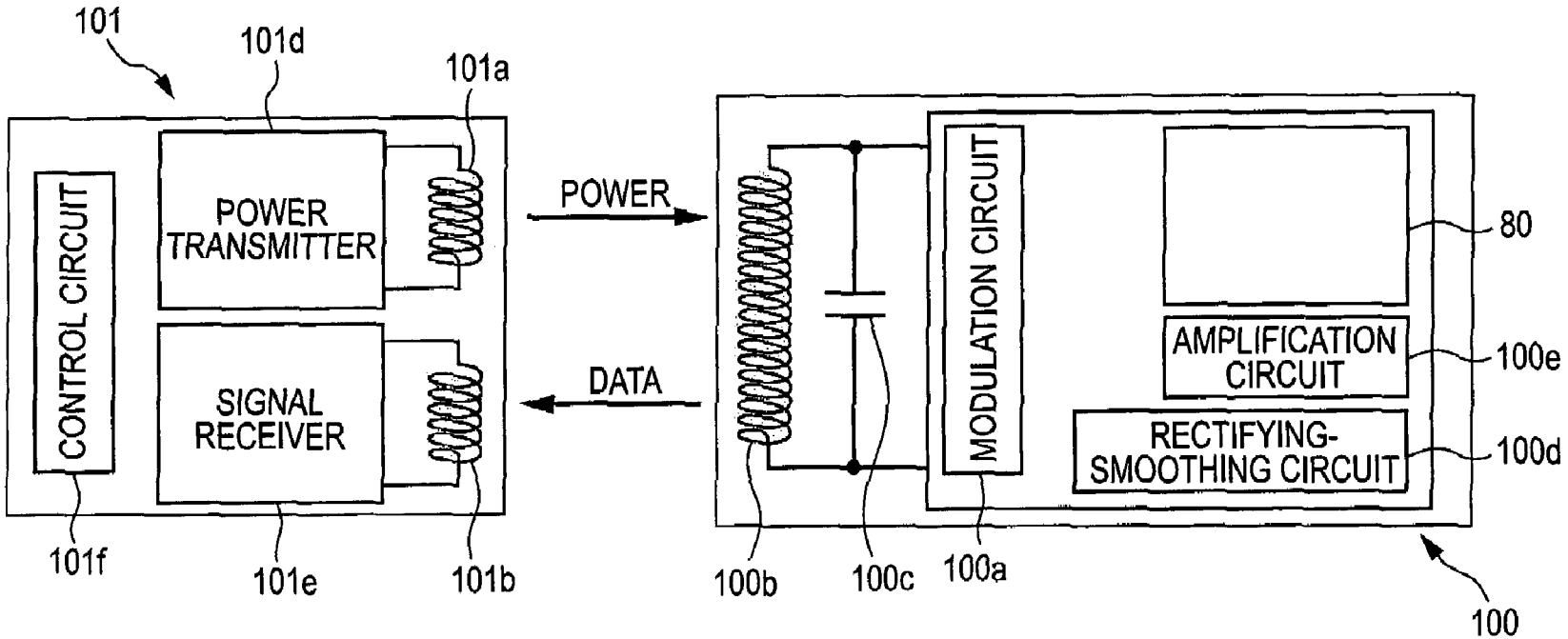
FIG. 7 is an electric circuit diagram showing the wireless configuration in which the MEMS acceleration sensor performs detection.

As described in (3), peripheral circuits can be easily formed on the substrate of a sensor using MEMS technology. Therefore, the sensor may be provided with a transmitting and receiving circuit, as shown in FIG. 7, to create a wireless configuration. Such wireless technology has been put to practical use as radio frequency identification (RFID) tags and the like, and is disclosed in Japanese Patent Laid-Open No. 2002-337426 (corresponding to U.S. Pat. No. 6,827,279) and the like.

Referring to FIG. 7, the MEMS acceleration sensor 80 and a wireless circuit are disposed on a common substrate to form an acceleration sensor unit 100. The MEMS acceleration sensor 80 is provided with an amplification circuit 100*e*, a rectifying-smoothing circuit 100*d*, a modulation circuit 100*a*, and an antenna coil 100*b*. The acceleration sensor unit 100 can wirelessly receive power from and transmit signals to a power-transmission/signal-receiving unit 101. Power radio signals emitted from a power transmitter 101*d* and a power supply coil 101*a* are received by the antenna coil 100*b* that constitutes a resonance circuit together with the resonant capacitor 100*c*, converted by the rectifying-smoothing circuit 100*d* to power for operation, and then supplied to the entire acceleration sensor unit 100. On the other hand, signals outputted from the MEMS acceleration sensor 80 are amplified by the amplification circuit 100*e*, modulated by the modulation circuit 100*a*, transmitted through the antenna coil 100*b* to a data receiving coil 101*b*, and transmitted further through a signal receiver 101*e* to a control circuit 101*f*.

In the acceleration sensor unit 100, the wireless configuration allows the removal of communication cables for communicating with the external devices, and thus greatly improves the freedom of installation of the sensor. While the rotating-body acceleration sensor 1 of the present embodiment is attached to the bearing 3, the installation of peripheral drive mechanisms may cause interference with wiring. The wireless configuration of the rotating-body acceleration sensor 1 gives a solution to such a problem.

Next, the operation of the sheet transport apparatus 26 having the rotating-body acceleration sensor 1 produced using MEMS technology will be described.

Figure 2A:
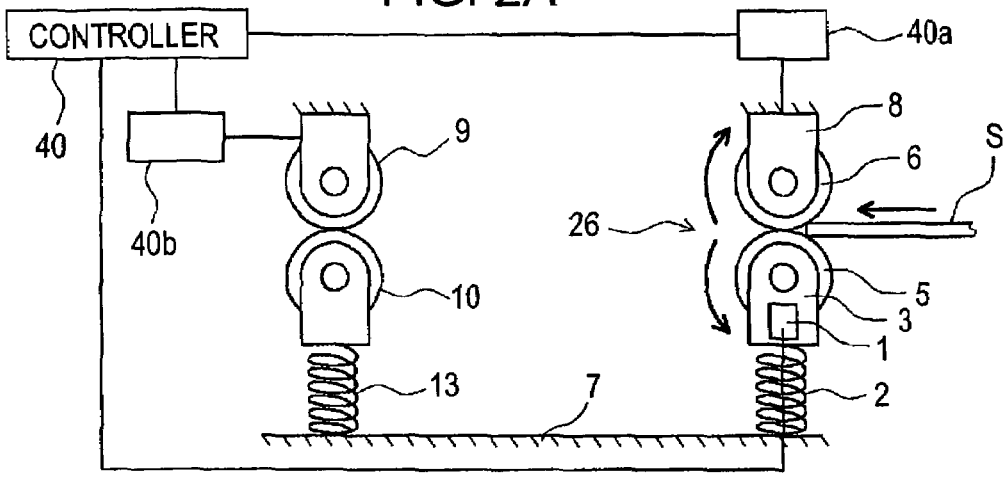
FIGS. 2A to 2C illustrate the operation of a sheet transport apparatus according to a first embodiment of the present invention.
Figure 2B:
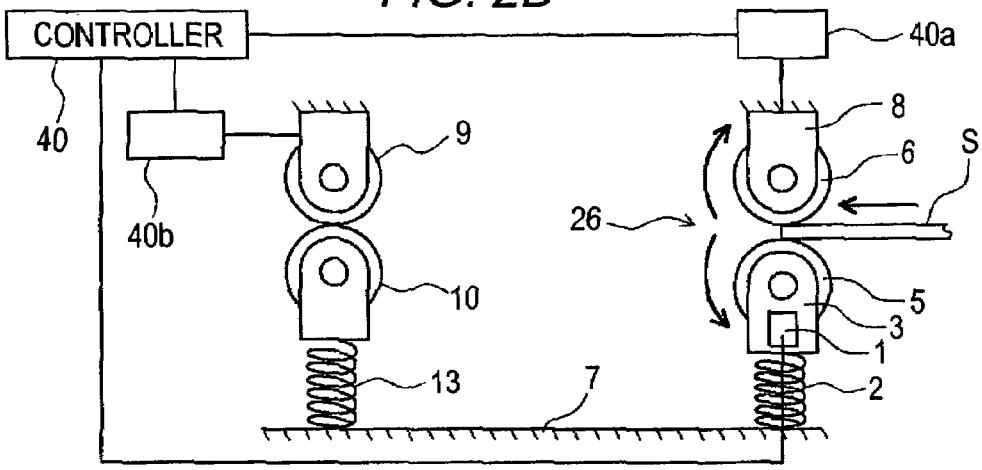
Figure 2C:
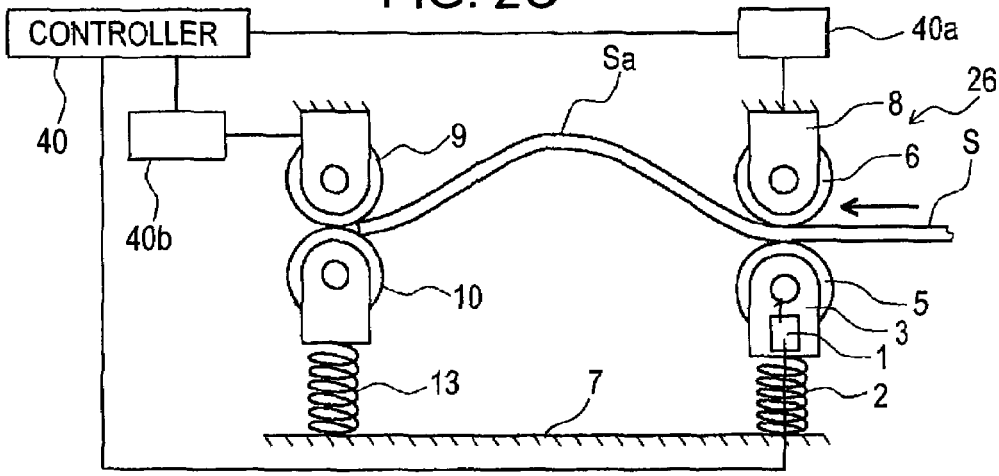
Figure 3:
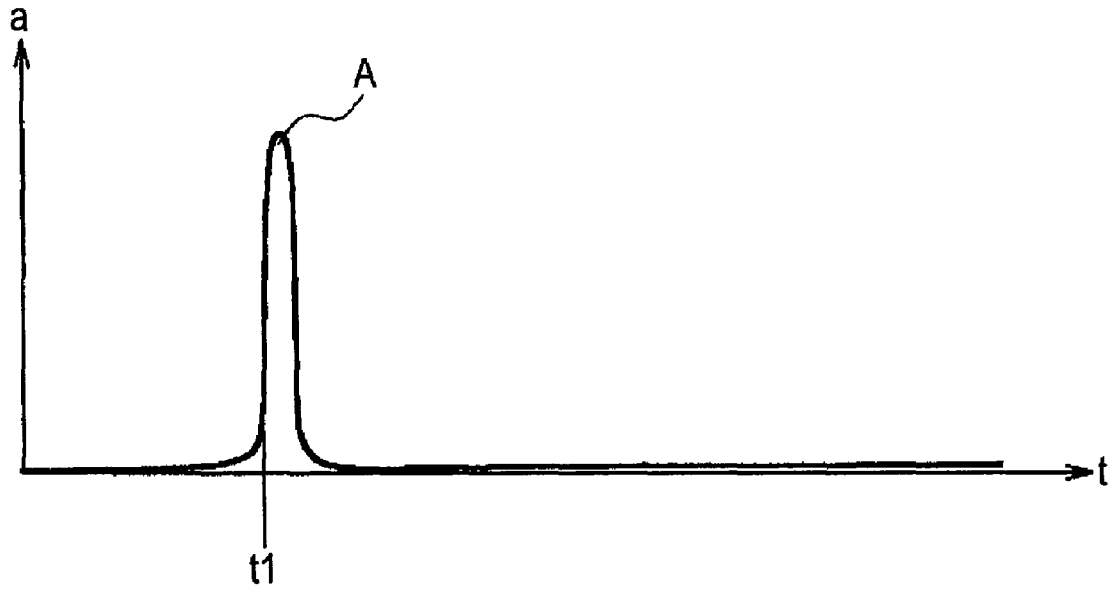
FIG. 3 shows a detection waveform of a rotating-body acceleration sensor.

When the sheet S from the feeder 31 of the copier 30 is introduced into the nip point between the pair of rollers 5 and 6, the driven roller 5 is pressed downward (see FIGS. 2A and 2B). At this point, the rotating-body acceleration sensor 1 outputs, to the controller 40, a change in acceleration "a" represented by a waveform in FIG. 3 as a change in capacitance. The controller 40 obtains arrival timing t1 of the sheet S from the waveform in FIG. 3 and determines the thickness of the sheet S by evaluating the double integral of a peak waveform A. Exit timing at which the rear edge of the sheet S exits the pair of rollers 5 and 6 can also be determined from the acceleration waveform.

The front edge of the sheet S is brought into contact with the pair of resist rollers 9 and 10 that do not rotate. The controller 40 stops the rotation of the driving roller 6, at predetermined timing, to create a loop Sa (see FIG. 2C) of the sheet S for correcting a skew thereof. Stop timing at which the controller 40 stops the rotation of the driving roller 6 is determined based not only on the arrival timing t1, but also on the thickness of the sheet S. For example, if it is determined that the sheet S is thin, the controller 40 delays the stop timing of the driving roller 6 to increase the size of the loop Sa (see FIG. 2C). If it is determined that the sheet S is thick, the controller 40 expedites the stop timing.

If the sheet S is thick paper, the size of the loop Sa is reduced. Even if the size of the loop Sa is small, the sheet S strikes the pair of resist rollers 9 and 10 at a strength sufficient to correct skew of the sheet S. If the size of the loop Sa is large, the sheet S is forced into the nip point between the pair of resist rollers 9 and 10 and may be folded.

After correcting the skew of the sheet S, the controller 40 waits for the image forming section 24 to be prepared, and feeds the sheet S into the image forming section 24 by rotating the resist roller 9 on the drive side.

The above-described sheet transport apparatus 26 of the first embodiment has the following advantages.

Since a flag, which is conventionally used, is not provided, transport of a thin sheet is not obstructed.

Since the rotating-body acceleration sensor 1 of several square millimeters is directly attached to the bearing 3, the space occupied by the rotating-body acceleration sensor 1 can be minimized. Moreover, even if a plurality of sheet paths is complex, there is no need to change the shape of a guide plate for the sheet paths.

Unlike the known contact-type probe sensor 264, there is no need to prepare a stable mounting base, as the rotating-body acceleration sensor 1 is directly attached to an object to be measured (bearing 3 of the driven roller 5). In other words, all that is needed is to allow a surface to accommodate the rotating-body acceleration sensor 1 of several square millimeters. It is hardly necessary to change the peripheral configuration.

For a known sensor, such as the sheet thickness sensor 270, that emits the reflecting light 270*a* to an object to be measured, the surface of the object must be given a smooth finish by blasting or the like. For the rotating-body acceleration sensor 1, it is not necessary to give a smooth finish to the surface of an object to be measured, as there is no need to emit detection light to the object.

Since there is no need for the rotating-body acceleration sensor 1 to emit detection light to an object to be measured, detection can be performed with little or no degradation in accuracy even if the rotating-body acceleration sensor 1 becomes soiled, to some extent, by oil of the drive unit of the sheet transport apparatus 26 and copier 30, and dust and dirt, such as sheet dust.

Sheet Transport Apparatus of Second Embodiment

Figure 8:
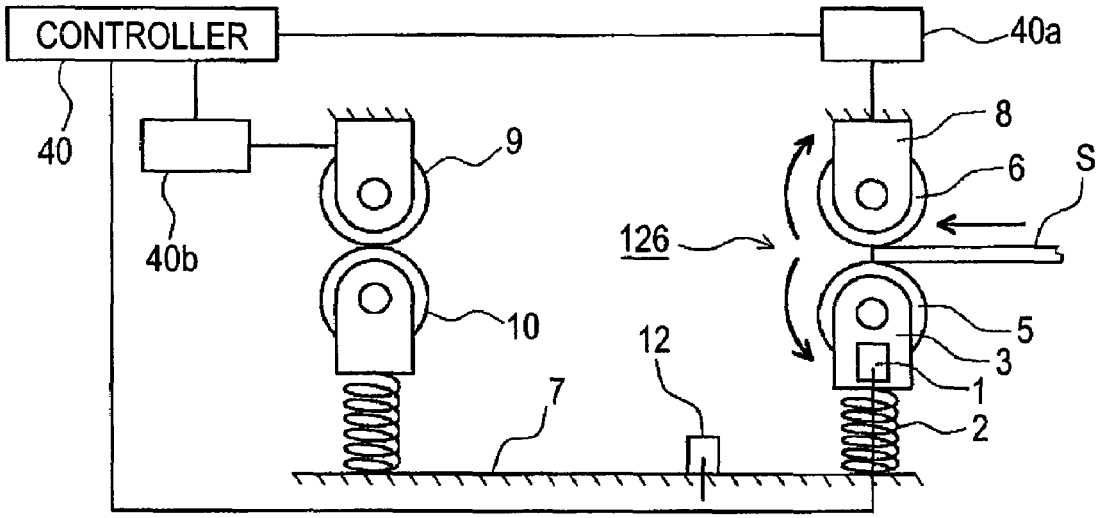
FIG. 8 illustrates the operation of a sheet transport apparatus of a second embodiment.

A sheet transport apparatus of the second embodiment will now be described with reference to FIG. 8 and FIG. 9.

A sheet transport apparatus 126 of the second embodiment differs from the sheet transport apparatus 26 of the first embodiment in that a frame 7 serving as a supporting body is provided with a supporting-body acceleration sensor 12 serving as a second acceleration sensor. In the sheet transport apparatus 126 of the present embodiment, the components that are the same as those of the first embodiment are given the same reference numerals and their description will be omitted. The operation of the sheet transport apparatus 126 is also the same as that of the sheet transport apparatus 26 of the first embodiment unless otherwise specified.

The sheet transport apparatus 126 of the present embodiment is designed not to be affected by vibration of the frame 7 that may cause detection errors in the rotating-body acceleration sensor 1.

Specifically, the frame 7 of the sheet transport apparatus 126 is provided with the supporting-body acceleration sensor 12, which detects vibration of the frame 7 to compensate for vibration of the frame 7 detected by the rotating-body acceleration sensor 1.

Figure 9A:
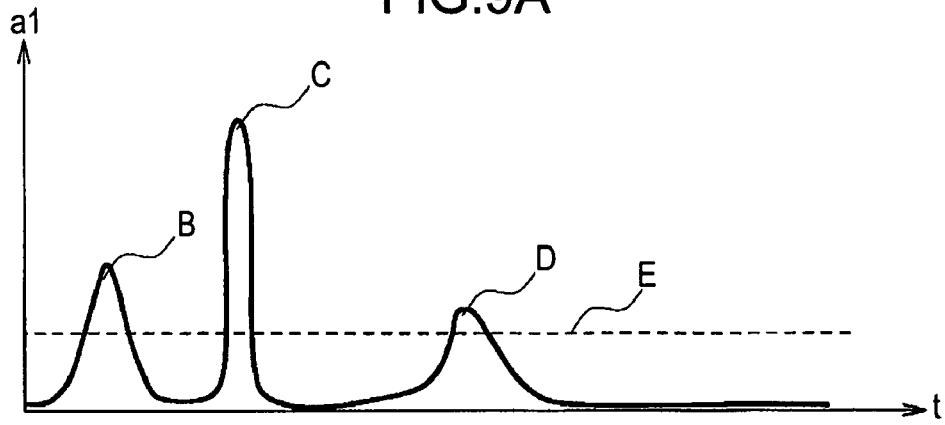
FIGS. 9A to 9C show detection waveforms of the sheet transport apparatus of the second embodiment.
Figure 9B:
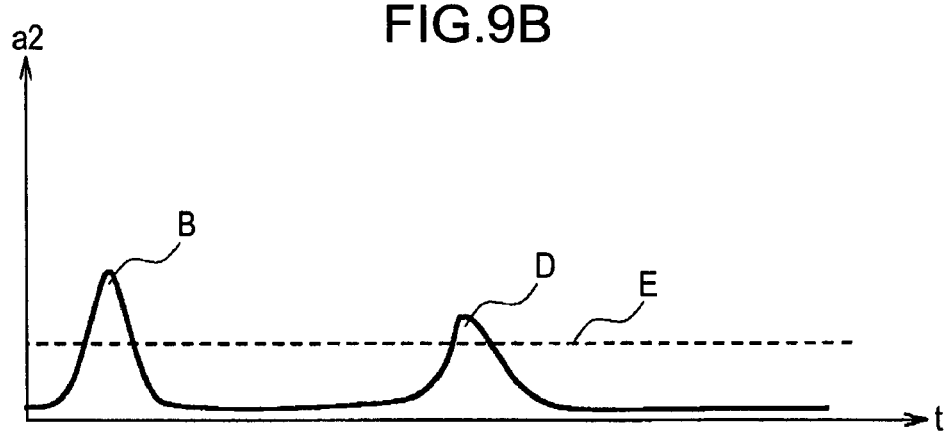

A further description will be given with reference to a detection waveform in FIG. 9. In processing output signals from the rotating-body acceleration sensor 1, the controller 40 subtracts the output of the supporting-body acceleration sensor 12 (see FIG. 9B) from the output of the rotating-body acceleration sensor 1 (see FIG. 9A). Then the controller 40 obtains arrival timing t1 of the sheet S from a peak C of the resultant signal waveform in FIG. 9C, and determines the thickness of the sheet S by evaluating the double integral of the waveform in FIG. 9C.

Figure 9C:
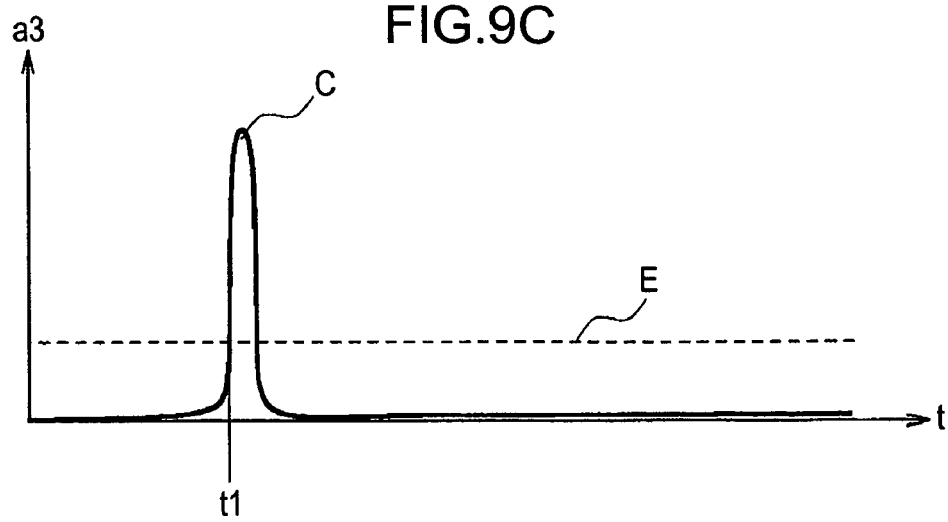
Figure 10:
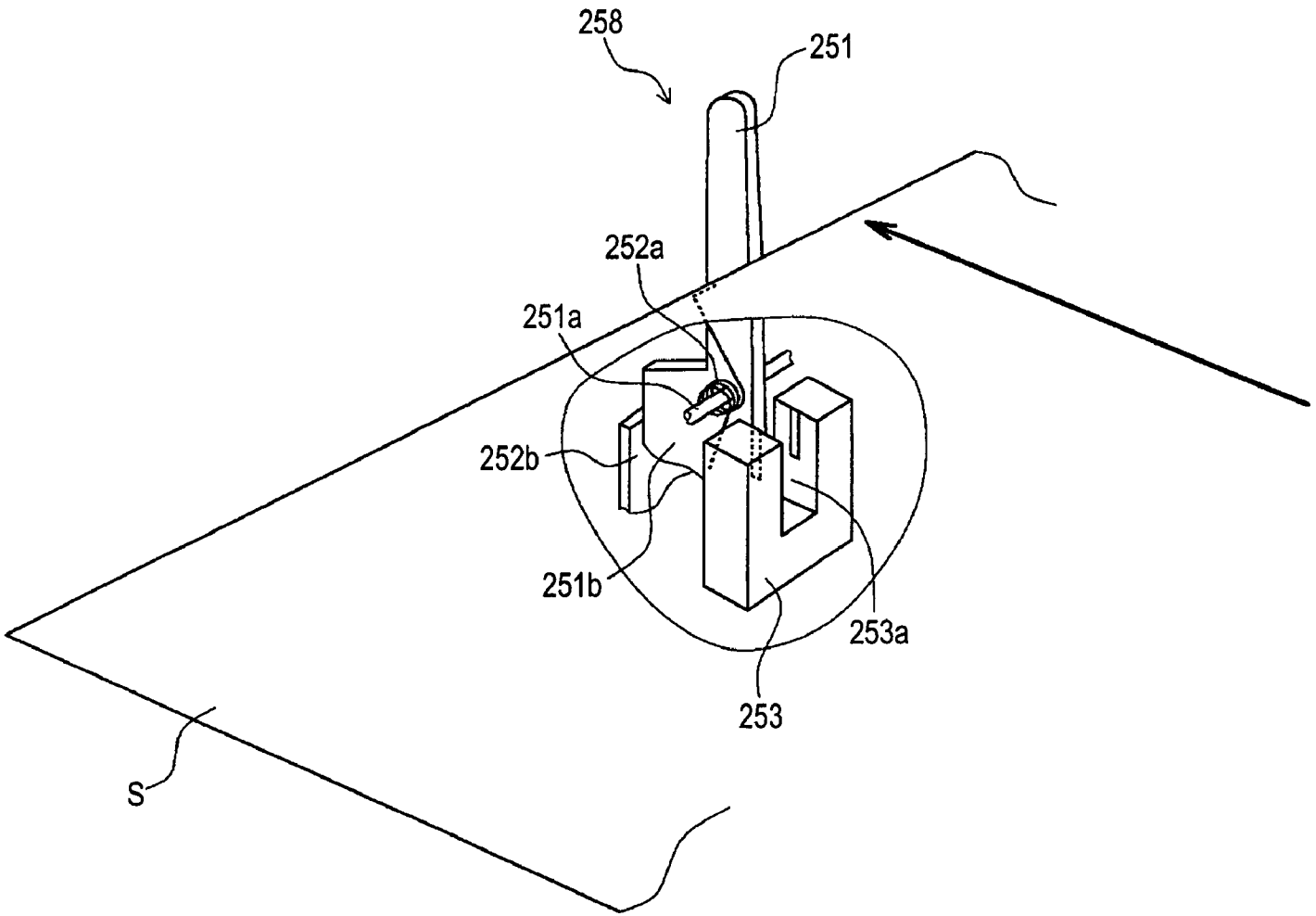
FIG. 10 PRIOR ART
FIG. 10 is a perspective view showing an example of a known sheet detector (photointerrupter sensor).
Figure 11:
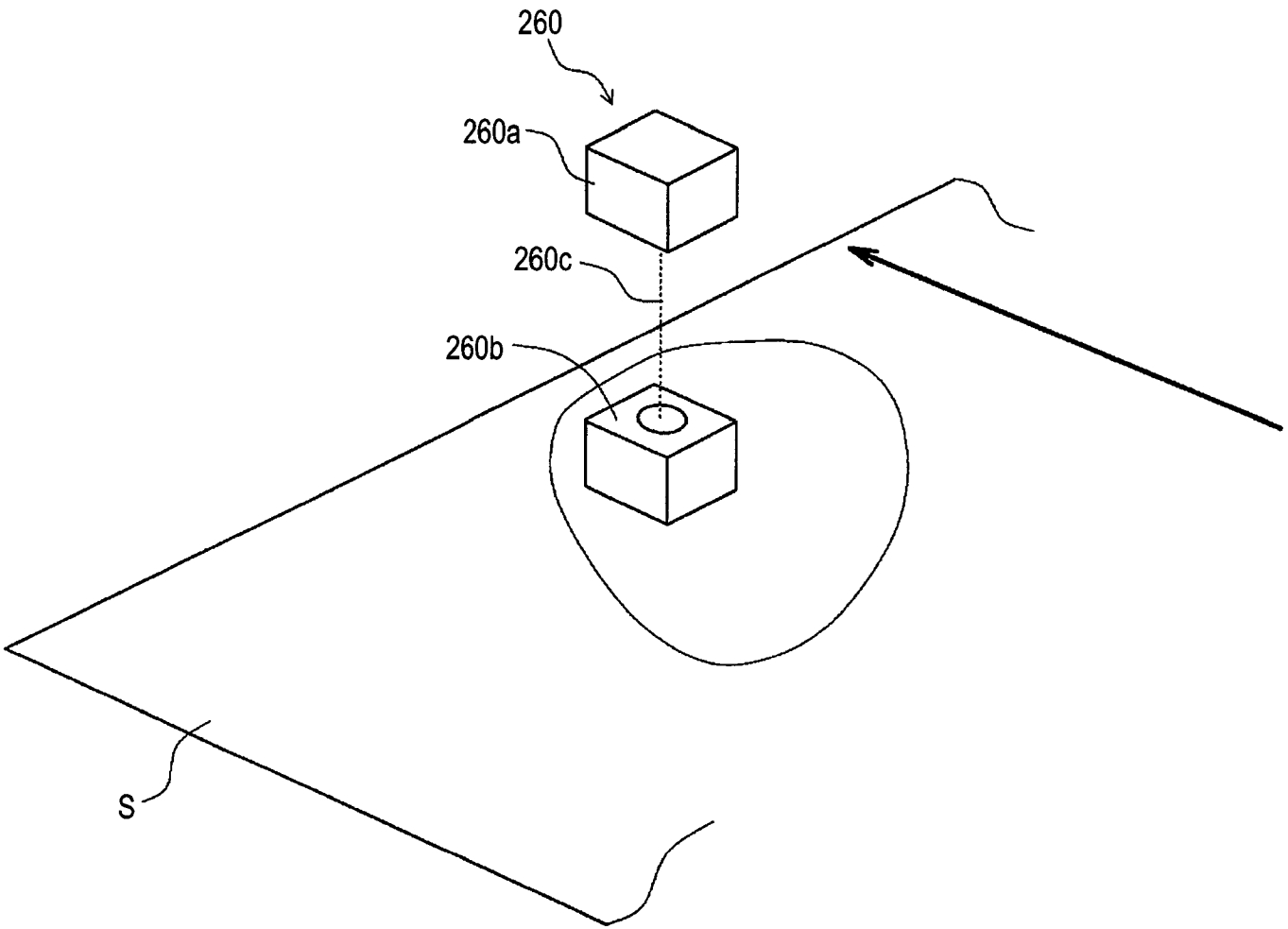
FIG. 11 PRIOR ART
FIG. 11 is a perspective view showing an example of a known sheet detector (light transmission sensor).

While the rotating-body acceleration sensor 1 detects externally-applied vibrations (for example, peaks B and D in FIGS. 9A and 9B) and may erroneously determine that the sheet S has arrived (when the peaks B and D in FIG. 9A exceed a threshold E), the controller 40 can eliminate the effect of external vibrations, as shown in FIG. 9C, by subtracting the output of the supporting-body acceleration sensor 12 from the output of the rotating-body acceleration sensor 1.

Figure 12:
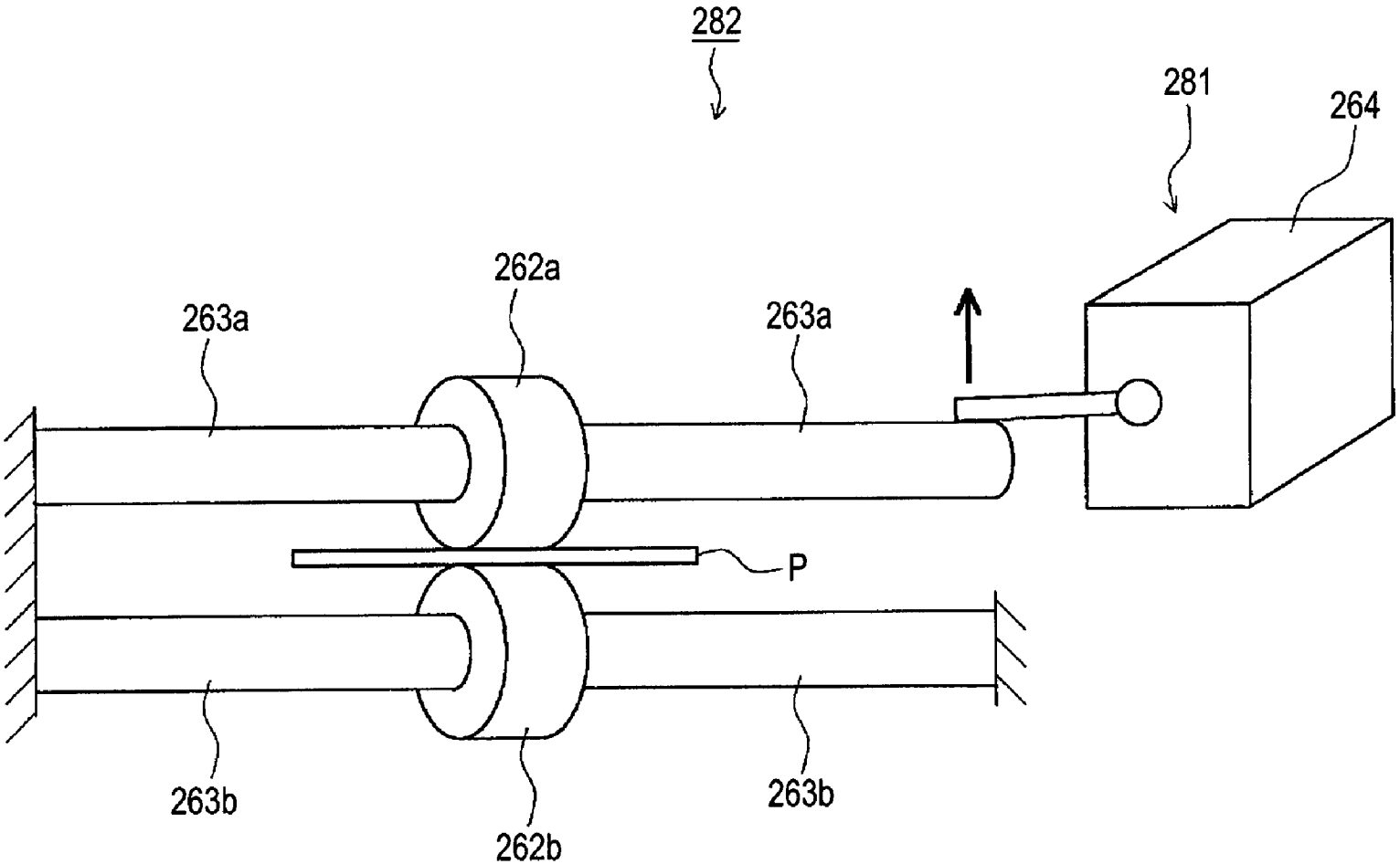
FIG. 12 PRIOR ART
FIG. 12 is a diagram showing an example of a known sheet detector (contact-type probe sensor).
Figure 13:
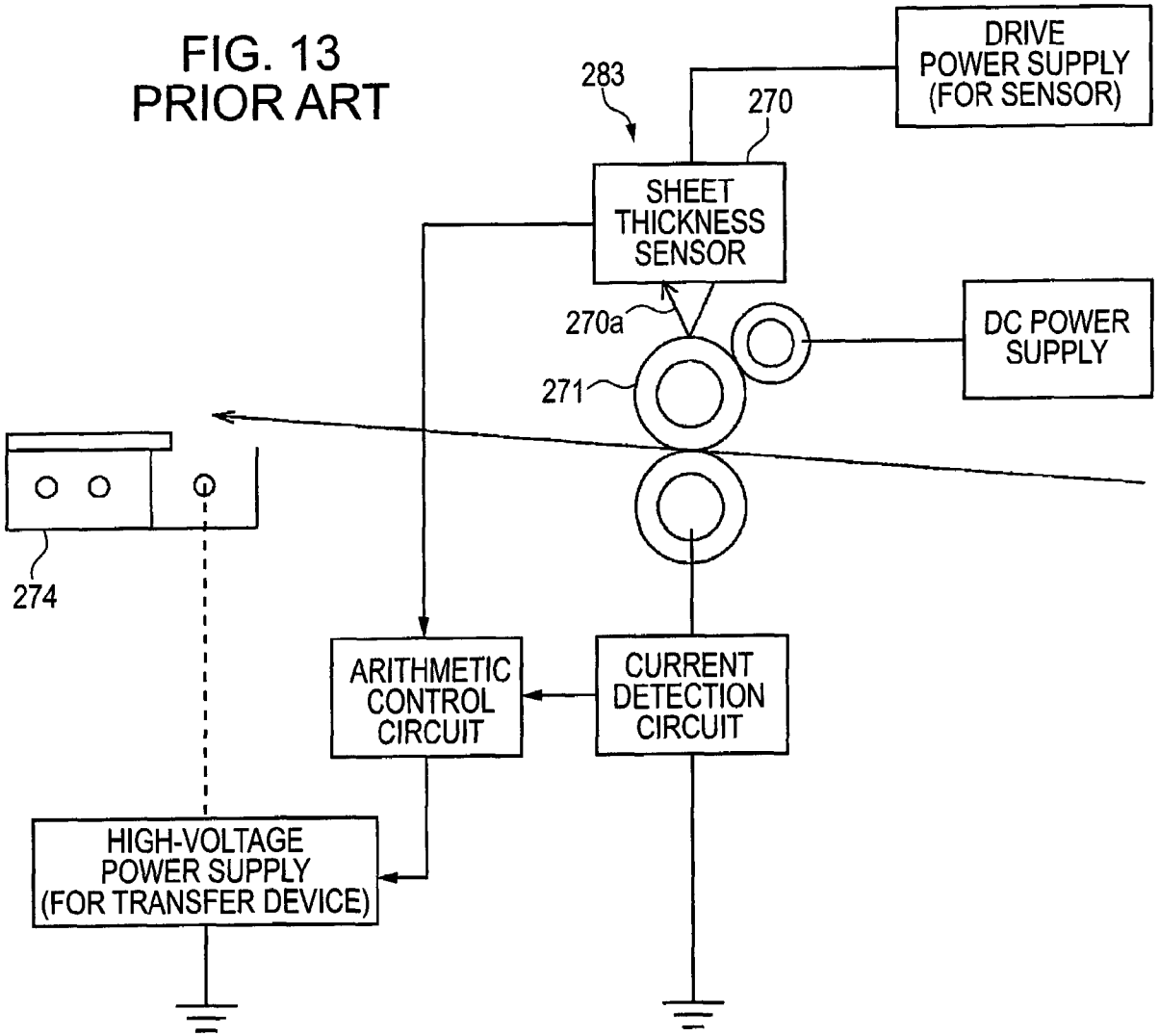
FIG. 13 PRIOR ART
FIG. 13 is a diagram showing an example of a known sheet detector (sheet thickness sensor).

In the sheet transport apparatus 126 of the present embodiment, external vibrations and the displacement of the driving roller 6 and bearing 3 can be measured in the same physical quantity units (acceleration). Therefore, by determining the difference between their corresponding signal waveforms, the effect of external vibrations can be reliably eliminated and a detection error can be easily prevented. On the other hand, even if the supporting-body acceleration sensor 12 for measuring external vibrations would be added to the known sheet transport apparatuses shown in FIG. 12 or 13, it is difficult to completely eliminate the effect of external vibrations since different types of physical quantities, such as the amount of displacement and acceleration, are compared.

In the sheet transport apparatus 126 of the present embodiment, the effect of externally-applied vibrations can be eliminated.

While the sheet transport apparatuses 26 and 126 of the first and second embodiments are disposed at a location from which a sheet is fed to the pair of resist rollers 9 and 10, the present invention is not limited to this configuration. The sheet transport apparatus may be provided at any location where the detection of arrival timing, exit timing, or thickness of a sheet is required. For example, the sheet transport apparatus may be attached to the pair of resist rollers and arranged near the cassette or manual paper feed such that the thickness of a sheet to be fed can be detected to control the speed of the fixer or the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-269017 filed Sep. 15, 2004, which is hereby incorporated by reference herein in its entirety.

What is claimed is:

1. A sheet transport apparatus comprising:

a pair of rotating bodies configured to move into contact with or to separate from each other, to rotate, and to transport a sheet interposed therebetween;

an acceleration sensor configured to detect acceleration of the movement of the pair of rotating bodies as the pair of rotating bodies move into contact with or separate from each other associated with the passage of the sheet between the pair of rotating bodies; and a controller configured to determine, based on the acceleration detected by the acceleration sensor, a state of the sheet being transported.

2. The sheet transport apparatus according to claim 1, wherein the controller determines, based on the acceleration detected by the acceleration sensor, at least one of (a) arrival timing at which a sheet reaches the pair of rotating bodies, (b) exit timing at which a sheet exits the pair of rotating bodies, and (c) a thickness of a sheet.

3. The sheet transport apparatus according to claim 2, further comprising:

a supporting body supporting the pair of rotating bodies; and a second acceleration sensor configured to detect acceleration of the supporting body, wherein the controller determines the state of the sheet based on the acceleration detected by the acceleration sensor and the acceleration detected by the second acceleration sensor.

4. The sheet transport apparatus according to claim 3, wherein the pair of rotating bodies comprises a fixed rotating body and a movable rotating body capable of moving into contact with or being separated from the fixed rotating body, wherein the acceleration sensor detects acceleration of the movable rotating body moving into contact with or separating from the fixed rotating body, and wherein the second acceleration sensor detects acceleration of movement of the supporting body supporting the movable rotating body.

5. The sheet transport apparatus according to claim 3, wherein each of the acceleration sensor and the second acceleration sensor comprises a detection part detecting acceleration of the fixed rotating body, and electrodes transmitting an output signal from the detection part to the outside, the detection part and the electrodes being formed on a wafer through a semiconductor manufacturing process and cut into chips.

6. An image forming apparatus comprising:

a sheet transport apparatus including:

a pair of rotating bodies configured to move into contact with or to separate from each other, to rotate, and to transport a sheet interposed therebetween;

an acceleration sensor configured to detect acceleration of the movement of the pair of rotating bodies as the pair of rotating bodies move into contact with or separate from each other associated with the passage of the sheet between the pair of rotating bodies; and a controller configured to determine, based on the acceleration detected by the acceleration sensor, a state of the sheet being transported; and an image forming section configured to form images on a sheet.

7. The image forming apparatus according to claim 6, further comprising a pair of rotating resist bodies located between the sheet transport apparatus and the image forming section, wherein the controller measures timing for feeding a sheet transported from the sheet transport apparatus to the image forming section, and wherein the controller determines the thickness of a sheet, controls the pair of rotating resist bodies based on the determined thickness, and determines the timing such that the smaller the thickness of the sheet the slower the timing.

8. The image forming apparatus according to claim 6, wherein the controller determines, based on the acceleration detected by the acceleration sensor, at least one of (a) arrival timing at which a sheet reaches the pair of rotating bodies, (b) exit timing at which a sheet exits the pair of rotating bodies, and (c) a thickness of a sheet.

9. The image forming apparatus according to claim 8, further comprising:

a supporting body supporting the pair of rotating bodies; and a second acceleration sensor configured to detect acceleration of the supporting body, wherein the controller determines the state of the sheet based on the acceleration detected by the acceleration sensor and the acceleration detected by the second acceleration sensor.

10. The image forming apparatus according to claim 9, wherein the pair of rotating bodies comprises a fixed rotating body and a movable rotating body capable of moving into contact with or being separated from the fixed rotating body, wherein the acceleration sensor detects acceleration of the movable rotating body moving into contact with or separating from the fixed rotating body, and wherein the second acceleration sensor detects acceleration of movement of the supporting body supporting the movable rotating body.

11. The image forming apparatus according to claim 9, wherein each of the acceleration sensor and the second acceleration sensor comprises a detection part detecting acceleration of the fixed rotating body, and electrodes transmitting an output signal from the detection part to the outside, the detection part and the electrodes being formed on a wafer through a semiconductor manufacturing process and cut into chips.

12. A sheet transport apparatus comprising:

a driving roller;

a driven roller pressed into contact with the driving roller to define a nip point therebetween;

an acceleration sensor attached to a movable bearing rotatably supporting the driven roller and detecting acceleration of the driven roller created by moving into contact with or separating from the driving roller when a sheet is introduced into the nip point between the driving roller and the driven roller; and a controller configured to determine, based on the acceleration detected by the acceleration sensor, a state of the sheet being transported.

13. The sheet transport apparatus according to claim 12, wherein the controller determines, based on the acceleration detected by the acceleration sensor, at least one of (a) arrival timing at which a sheet reaches the nip point between the driving roller and the driven roller, (b) exit timing at which a sheet exits the nip point between the driving roller and the driven roller, and (c) a thickness of a sheet.

14. An image forming apparatus comprising:

a driving roller;

a driven roller pressed into contact with the driving roller;

an acceleration sensor attached to a movable bearing rotatably supporting the driven roller and detecting acceleration of the driven roller created by moving into contact with or separating from the driving roller when a sheet is introduced into a nip point between the driving roller and the driven roller;

a controller configured to determine, based on the acceleration detected by the acceleration sensor, a state of the sheet being transported; and an image forming section configured to form images on a sheet.

15. The sheet transport apparatus according to claim 1, wherein the pair of rotating bodies comprises a fixed rotating body and a movable rotating body capable of moving into contact with or separating from the fixed rotating body, wherein the acceleration sensor detects acceleration of the movable rotating body moving into contact with or separating from the fixed rotating body.

16. The image forming apparatus according to claim 6, wherein the pair of rotating bodies comprises a fixed rotating body and a movable rotating body capable of moving into contact with or separating from the fixed rotating body, wherein the acceleration sensor detects acceleration of the movable rotating body moving into contact with or separating from the fixed rotating body.

17. The sheet transport apparatus according to claim 12, wherein the driven roller is capable of moving into contact with or separating from the driving roller, wherein the acceleration sensor detects acceleration of the driven roller moving into contact with or separating from the driving roller.

18. The image forming apparatus according to claim 14, wherein the driven roller is capable of moving into contact with or separating from the driving roller, wherein the acceleration sensor detects acceleration of the driven roller moving into contact with or separating from the driving roller.

* * * * *